United States Patent [19]

Sills, Jr.

[11] Patent Number: 4,752,999

[45] Date of Patent: Jun. 28, 1988

[54] SPHERICAL TRANSFORMER

[76] Inventor: Jerome C. Sills, Jr., Box A20, 575 Campbell Ave., Westhaven, Conn. 06516

[21] Appl. No.: 93,589

[22] Filed: Sep. 4, 1987

[51] Int. Cl.[4] ..... H01F 41/02; H01F 27/26; H01F 27/30

[52] U.S. Cl. ..... 29/605; 336/198; 336/207; 336/230; 336/233

[58] Field of Search ..... 336/196, 198, 197, 208, 336/225, 233, 230, 221, 207; 29/602 R, 605

[56] References Cited

U.S. PATENT DOCUMENTS 1,546,424 7/1925 Wood ..... 336/230 X

*Primary Examiner*—Thomas J. Kozma
*Attorney, Agent, or Firm*—Leon Gilden

[57] ABSTRACT

A spherical transformer and process for forming same is set forth. Hollow, hemispherical elements are rotated to enable a cooperating cutting tool to impart a helical impression therein. An adhesive is sprayed into the interiors of both hemispheres and thereafter powdered metal, such as stainless steel, is directed thereon to form a sheet-like core that when both hemispheres are joined to provide an uninterrupted metal core with said hemisphere. A primary winding is inserted into the aforenoted grooves about one hemisphere and a secondary winding is positioned into the helically cut grooves in said second hemisphere. The thusly formed transformer is positioned on a base for a stability thereof.

4 Claims, 1 Drawing Sheet

SPHERICAL TRANSFORMER

BACKGROUND OF THE INVENTION

1. Field of the Invention

The present invention relates to transformers, and more particularly pertains to a new and improved spherical transformer which includes economy of construction, improved ease of repair, and improved effective life due to protection of the core and winding thereof.

2. Description of the Prior Art

The use of transformers in AC systems serve the basic function of changing electrical power from one voltage level to another and of insulating between portions of a circuit when conducted coupling is not desired. Essentially, spaced coils are arranged as a current through one will produce magnetic flux linking both. A current made to flow in a first coil will establish a magnetic flux within a linking core and if the core permeability is relatively high as compared to the surrounding medium, a large portion of the magnetic flux will pass through the secondary coil. While conventional construction of transformers has remained unchanged for many years, there have been recent developments in attempts to develop a more efficient transformer particularly of spherical construction. In this connection, there have been several attempts to develop such spherical transformers and windings. For example, U.S. Pat. No. 1,748,802 to Seymour sets forth a helical winding formed of interconnected groups of helical convolutions of one group inserted within the other. The patent fails to set forth a transformer of new and improved construction as provided by my invention.

U.S Pat. No. 2,013,764 to Putman sets forth a method of making coils wherein die structure is utilized to deform windings to hemispherical shape.

U.S. Pat. No. 2,179,257 to Goloviznin sets forth a transformer formed with a solid metal core of spherical construction. A secondary winding is concentrically formed in spherical shape imposed over a primary winding. While an improvement over prior art, the coil still fails to provide a coil of spherical construction formed of a laminate shell of conducted material formed of secure hemispherical portion for improved use and ease of manufacture.

U.S. Pat. No. 2,265,041 to Hipple sets forth a spherical coil of superimposed coil windings in a pre-selected pattern for improved output thereof. The shortcomings of the Hipple patent are consistent with prior art.

U.S. Pat. No. 4,504,812 to Moermond sets forth an improved spherical transformer utilizing a shield device imposed over the windings for protection of the coils and its interior construction. The transformer set forth by the patent, while an improvement in the prior art, does not provide a transformer of a single core of sheet-like construction formed of plural hemispherical halves enabling embedded windings to yield enhanced electrical transforming abilities.

Further examples of of spherical winding construction are exemplified in U.S. Pat. No. 1,587,381 to Hisky and U.S. Pat. No. 1,521,585 to Louis providing spherical windings in radial circuits.

It may be appreciated that there exists a continuing need for a new and improved transformer of spherical construction in stressing both the problems of ease of construction and enhanced output, and in this respect the present invention substantially fulfills this need.

SUMMARY OF THE INVENTION

In view of the foregoing disadvantages inherent in the known types of transformers now present in the prior art, the present invention provides an spherical transformer formed of plural hemispherical segments secured together of a single sheetlike core member providing enhanced output of my transformer apparatus. As such, the general purpose of the present invention, which will be described subsequently in greater detail, is to provide a new and improved spherical transformer which has all the advantages of the prior art transformers and none of the disadvantages.

To attain this, the present invention comprises a spherical transformer formed of plural hemispherical portions. Each hemispherical portion is initially helically grooved for accommodation of respective primary and secondary windings. An adhesive substrate is sprayed into each hemispherical portion, such as a varnish-like material, where prior to drying of said substrate, a powdered metal suitable as core material, such as stainless steel, is deposited on said adhesive substrate to completely cover said adhesive substrate forming a sheet-like core member. The two respective hemispherical portions are thereafter secured utilizing adhesives or mechanical fastening techniques. The respective windings of primary and secondary configurations are thereafter positioned within the pre-grooved portion of the thusly formed sphere. Optional securement elements may be positioned in an overlying relationship to the formed grooves in the sphere to firstly position and secure the windings therein and secondly protect same.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, Which is measured by the claims, nor is it intended to be limiting as to the scope of the invention in any way.

It is therefore an object of the present invention to provide a new and improved spherical transformer which has all the advantages of the prior art spherical transformer and none of the disadvantages.

It is another object of the present invention to provide a new and improved spherical transformer which may be easily and efficiently manufactured and marketed.

It is a further object of the present invention to provide a new and improved spherical which is of a durable and reliable construction.

An even further object of the present invention is to provide a new and improved spherical transformer which is susceptible of a low cost of manufacture with regard to both materials and labor, and which accordingly is then susceptible of low prices of sale to the consuming public, thereby making such spherical transformers economically available to the buying public.

Still yet another object of the present invention is to provide a new and improved spherical transformer which provides in the apparatuses and methods of the prior art some of the advantages thereof, while simultaneously overcoming some of the disadvantages normally associated therewith.

Still another object of the present invention is to provide a new and improved spherical transformer of improved construction including plural hemispherical portion secured together.

Yet another object of the present invention is to provide a new and improved spherical transformer wherein individual hemispherical portions are pre-grooved for acceptance of windings therein.

Even still another object of the present invention is to provide a new and improved spherical transformer wherein powdered metal suitable for transformer core construction is applied in powdered form over an adhesive substrate to form a continuous sheet-like core member within the assembled spherical transformer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
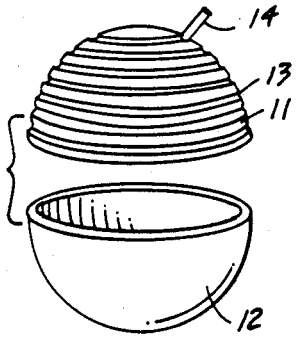
FIG. 1 is an isometric illustration of the instant invention setting forth the grooving of separate hemispherical portions.

With reference now to the drawings, and in particular to FIG. 1 thereof, a new and improved spherical transformer embodying the principles and concepts of the present invention and generally designated by the reference numeral 10 will be described.

More specifically, hemispherical portion 11 and 12, as illustrated in FIG. 1 and utilized throughout my invention, are formed of an insulative material chosen for economy of manufacture and use and typically may be formed of plexiglass, but a material of similar insulative properties may be utilized. In FIG. 1 upper spherical portion 11 is rotated and grooves imparted therein by means of a grooving tool !4. Alternatively, grooving tool 14 may be revolved about a stationary hemispherical portion. Grooves 18 may be of a chosen configuration but helical grooving has proven to be effective. Similarly, lower hemispherical portion 12 is grooVed with an imparted groove 15 formed therein.

Figure 2:
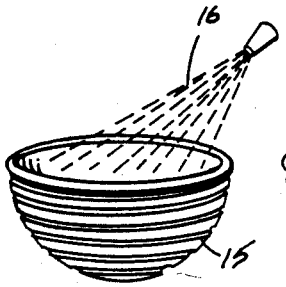
FIG. 2 is an isometric illustration setting forth the application of an adhesive-like film into the hemispherical portions.
Figure 3:
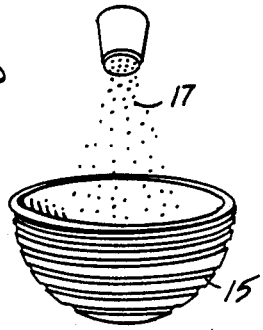
FIG. 3 is an isometric illustration of the instant invention setting forth the application of powdered metal for forming the core of the invention within the hemispherical portions.

An adhesive-like matrix is next imparted onto inner surface of both hemispherical portions 11 and 12. For purposes of economy and efficiency the adhesive-like matrix may be sprayed or applied in layers, as illustrated in FIG. 2. The next stage entails the application of powdered metal to form the core of the spherical transformer. Most frequently used are alloys of iron and typically a silica alloy with percentage variations of zero to six percent may be utilized dependent upon need. A nickle iron alloy or even a chromium iron alloy may also be utilized.

Figure 4:
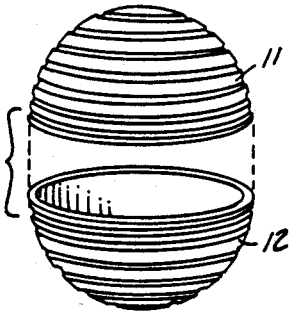
FIG. 4 is an isometric illustration of the present invention setting forth the securement of respective hemispherical portions to one another that have been grooved and formed with an inner metal laminate.
Figure 5:
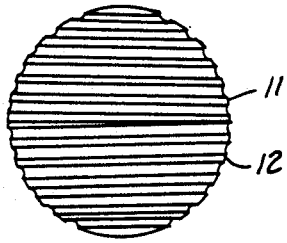
FIG. 5 is a side orthographic illustration of the present invention illustrating the hemispherical portions secured together to form a spherical member.
Figure 6:
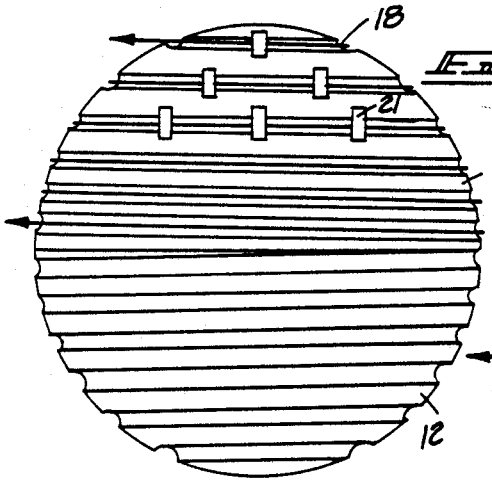
FIG. 6 is a side orthographic illustration of the present invention illustrating the primary winding positioned within the upper portion of the spherical transformer.
Figure 7:
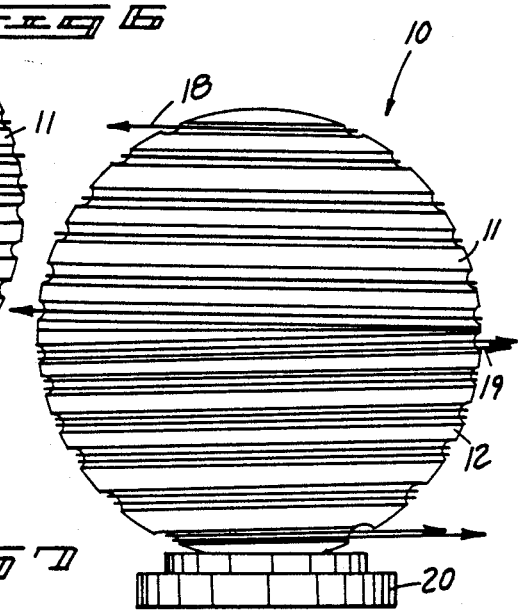
FIG. 7 is side orthographic illustration of the present invention illustrating the primary and secondary windings positioned in the hemispherical transformer.

The application of the iron alloy is applied to completely cover the adhesive matrix that in turn forms a sheetlike metallic member to provide a respective core in the completed circle transformer. The next stage of the process associates upper and lower spherical portion 11 and 12 and joins them, as illustrated in FIG. 4. Various joing techniques may be employed such as adhesive bonding or even mechanical joining by use of well known fasteners (not shown). The completed spherical transformer is illustrated in FIG. 5 awaiting application of windings. A primary winding is illustrated and applied in FIG. 6 indicated as 18. Secondary windings 19 are applied, as illustrated in the completed spherical transformer of FIG. 7, and for purposes of illustration the turns of winding 19 twice that of winding 18 to provide a step-up transformer, as well known in the art. Finally the spherical transformer is positioned on a base portion 20 for stability.

If desired, securement straps 21 are secured and positioned in overlying relationship to windings 18 and 19 within respective grooves 13 and 15 to firstly provide a degree of protection to the windings and secondly, assure containment of the respective windings within respective grooves.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A process for forming a spherical transformer comprising the steps of, a. providing first and second hemispherical portions, and b. imparting grooves into first and second exterior surface of said hemispherical portions, and c. adhesively securing a powdered metallic alloy onto the inner surfaces of said first and second hemispherical portions to form a continuous sheetlike lamination therein, and d. securing said first and second hemispherical portions together, and e. positioning a first winding into said grooves of said first hemispherical portion, and f. imparting a second winding into said grooves of said second hemispherical portion.

2. A process for forming a spherical transformer as set forth in claim 1 wherein said metallic alloy is adhesively secured to said inner surface of said first and second hemispherical portion by initially applying an adhesive, matrix-like material into said inner surfaces and then applying the metallic alloy in powdered form to form said inner laminate.

3. A process for forming a spherical transformer as set forth in claim 1 wherein said grooves are imparted into said hemispherical portion by rotating said hemispherical portions relative to a grooving tool.

4. A process for forming a spherical transformer as set forth in claim 1 wherein said spherical transformer is positioned and mounted onto a base element formed with a complementary concave surface to accept a spherical transformer and a planar surface opposite said concave surface for stable positioning on desired support surfaces.

5. A process for forming a spherical transformer as set forth in claim 1 wherein securement straps of a length greater than the length of a groove formed in said spherical transformer but less then the width of two grooves are secured over said groove to protect and secure said windings positioned therein.

* * * * *